US009327931B2

(12) United States Patent
Izumi

(10) Patent No.: US 9,327,931 B2
(45) Date of Patent: May 3, 2016

(54) CONTINUOUS ROLL SHEET HOLDING APPARATUS AND PRINTING APPARATUS

(75) Inventor: Masato Izumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 12/965,116

(22) Filed: Dec. 10, 2010

(65) Prior Publication Data

US 2011/0262202 A1 Oct. 27, 2011

(30) Foreign Application Priority Data

Apr. 23, 2010 (JP) ..... 2010-100087

(51) Int. Cl.

| | |
|---|---|
| ***B41J 15/04*** | (2006.01) |
| ***B65H 16/06*** | (2006.01) |
| ***B65H 16/10*** | (2006.01) |

(52) U.S. Cl.

CPC ..... *B65H 16/06* (2013.01); *B41J 15/04* (2013.01); *B65H 16/10* (2013.01); *B65H 2301/121* (2013.01); *B65H 2301/413683* (2013.01); *B65H 2801/06* (2013.01)

(58) Field of Classification Search

CPC ..... B41J 15/02; B41J 15/04; B41J 17/36; B41J 33/003; B65H 16/06; B65H 16/10; B65H 17/14; B65H 75/22; B65H 75/172; B65H 75/185

USPC ..... 400/525; 242/570, 578, 578.2, 590, 242/591, 596.4, 596.5; 226/19

See application file for complete search history.

(56) References Cited

U.S. PATENT DOCUMENTS

| | | | | |
|---|---|---|---|---|
| 6,491,252 | B2 * | 12/2002 | Komatsu et al. | 242/596.1 |
| 6,561,453 | B1 * | 5/2003 | Shinga | 242/595.1 |
| 6,824,091 | B2 * | 11/2004 | Inana | 242/578.2 |
| 6,877,920 | B2 * | 4/2005 | Fujioka | 400/613 |
| 6,910,655 | B2 * | 6/2005 | Fujioka | 242/545.1 |
| 7,284,725 | B2 * | 10/2007 | Inana | 242/578.2 |
| 2002/0096075 | A1 | 7/2002 | Kaya | |
| 2003/0156881 | A1 | 8/2003 | Iwata | |
| 2006/0024114 | A1 | 2/2006 | Lyman et al. | |
| 2008/0277851 | A1 | 11/2008 | Genta | |
| 2009/0226236 | A1 * | 9/2009 | Yamashita et al. | 400/621 |
| 2009/0242603 | A1 * | 10/2009 | Kobayashi et al. | 226/179 |

FOREIGN PATENT DOCUMENTS

| | | | |
|---|---|---|---|
| CN | 1157938 | A | 8/1997 |
| CN | 1636754 | A | 7/2005 |
| CN | 1746037 | A | 3/2006 |
| CN | 101544136 | A | 9/2009 |

(Continued)

*Primary Examiner* — Jill Culler
*Assistant Examiner* — Marissa Ferguson Samreth
(74) *Attorney, Agent, or Firm* — Canon USA Inc. IP Division

(57) ABSTRACT

A continuous roll sheet holding apparatus that fits rotary shafts to both ends of a continuous sheet wound in a roll shape, and rotatably supports each rotary shaft, thereby supporting the continuous sheet to be pulled out, includes holding flanges configured to rotatably support the respective rotary shafts, a driven unit which is integrally disposed in one of the rotary shafts and configured to receive driving from an apparatus body, and a flange holding unit configured to support each of the holding flanges, and abut on the holding flange to regulate a position of the holding flange in a direction of the rotary shaft and a direction orthogonal to the rotary shaft.

25 Claims, 16 Drawing Sheets

(56) References Cited

FOREIGN PATENT DOCUMENTS

| | | | |
|---|---|---|---|
| JP | 2002-046902 | A | 2/2002 |
| JP | 2002-46902 | A | 2/2002 |
| JP | 2003-136799A | A | 5/2003 |
| JP | 2007-261086A | A | 10/2007 |
| JP | 2007-261754 | A | 10/2007 |
| JP | 2007-290865 | A | 11/2007 |
| JP | 2009-234668A | A | 10/2009 |

* cited by examiner

CONTINUOUS ROLL SHEET HOLDING APPARATUS AND PRINTING APPARATUS

BACKGROUND OF THE INVENTION

1. Field of the Invention

The present invention relates to a continuous roll sheet holding apparatus and a printing apparatus that includes the same.

2. Description of the Related Art

Japanese Patent Application Laid-Open No. 2002-46902 discusses a roll sheet holding apparatus that is applied to a printing apparatus and fitted to an end of a sheet wound in a roll shape to rotatably hold the sheet.

The roll sheet holding apparatus includes, to fit holding flanges to both ends of the roll sheet and rotatably hold the roll sheet, a driven gear to which a driving force is transmitted, and a transmission member that transmits a rotational force of the driven gear to one of the holding flanges. The roll sheet holding apparatus further includes a rotary shaft rotated by a driving force from a driving source of the roll sheet holding apparatus in a direction parallel to an axial direction of the roll sheet, and a driving force transmission unit including a driving force transmission gear slidable in an axial direction of the rotary shaft. The driving force transmission gear can stop at a predetermined position in the axial direction of the rotary shaft, and engages with the driven gear of the holding flange to transmit the driving force.

A roll sheet housing unit includes engaged portions to fix the respective holding flanges fitted to both ends of the roll sheet. The holding flange includes an engaging portion that can engage with the engaged portion.

As compared with a conventional method for inserting a holding shaft into a core of a roll sheet to fix the roll sheet, fitting of a long holding shaft to the roll sheet is unnecessary. Thus, this configuration can improve roll sheet replacement work.

In a printing apparatus, driving is transmitted to rotate and feed the roll sheet to a printing unit. Consequently, in loading positions of the roll sheet and the holding flanges, position regulation is usually imposed with respect to a winding direction. Also in loading of the roll sheet in the roll sheet housing unit, a phase occurs between the winding direction and the loading direction of the roll sheet.

When the loading positions of the holding flanges are determined to be incorrect with respect to the winding direction after the holding flanges have been fitted to the roll sheet, the holding flanges must be removed from the roll sheet to be fitted to correct positions again.

When the holding flange that includes the driving force transmission unit is not fitted to a determined end side of the roll sheet but loaded in the roll sheet housing unit with respect to the winding direction of the roll sheet, the winding direction of the roll sheet is reversed. When the roll sheet is fed to the printing unit while the winding direction is reverse, ink is discharged to a rear surface of the roll sheet. The ink is thus insufficiently absorbed by the sheet, and the roll sheet is conveyed to a conveyance path on the downstream side of the printing unit. Consequently, the ink may be transferred to a conveyance unit, staining a sheet to be conveyed next.

Conventionally, the driving force transmission unit is connected when the roll sheet is loaded in the roll sheet housing unit. The loading directions of the holding flanges with respect to the roll sheet housing unit are thus predetermined. Consequently, the operation must be performed while checking engaging positions of the holding flanges and an engaged position of the roll sheet, making the loading difficult.

SUMMARY OF THE INVENTION

An embodiment of the present invention is directed to improvement in loading work of a continuous roll sheet.

According to an aspect of the present invention, a continuous roll sheet holding apparatus that fits rotary shafts to both ends of a continuous sheet wound in a roll shape, and rotatably supports each rotary shaft, thereby supporting the continuous sheet to be pulled out, includes holding flanges configured to rotatably support the rotary shafts, a driven unit which is integrally disposed in one of the rotary shafts and configured to receive driving from an apparatus body, and a flange holding unit configured to support each of the holding flanges, and abut on the holding flange to regulate a position of the holding flange in a direction of the rotary shaft and a direction orthogonal to the rotary shaft.

According to an embodiment of the present invention, loading work of the continuous roll sheet can be improved.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An ink-jet printing apparatus that employs a continuous roll sheet holding apparatus according to an exemplary embodiment of the present invention will be described. The printing apparatus according to the present exemplary embodiment is a high-speed line printer that uses a long continuous sheet (longer than a repeated print unit (referred to as one page or a unit image) in a conveying direction, and supports both one-side printing and two-sided printing. For example, the printing apparatus is suited for printing on a great many sheets in a print laboratory.

In the Specification, even when a plurality of small images, characters or blanks is mixed in an area of one print unit (one page), such items included in the area are collectively referred to as one unit image. In other words, the unit image means one unit of print image (one page) when a plurality of pages is sequentially printed on a continuous sheet. A length of the unit image varies depending on an image size to be printed. For example, an L-size photograph has a length of 135 millimeters in a sheet conveying direction. An A4-size sheet has a length of 297 millimeters in the sheet conveying direction.

The present invention is widely applicable to printing apparatuses such as a printer, a printer multifunction peripheral, a copying machine, a facsimile apparatus, and a manufacturing apparatus of various devices. A printing method can employ any one of such methods as an ink-jet method, an electrophotographic method, a thermal transfer method, a dot-impact method, and a liquid development method. The present invention is also applicable to a sheet processing apparatus that performs various processes (recording, processing, coating, irradiation, reading, and inspection) on a roll sheet in addition to printing.

Figure 1:
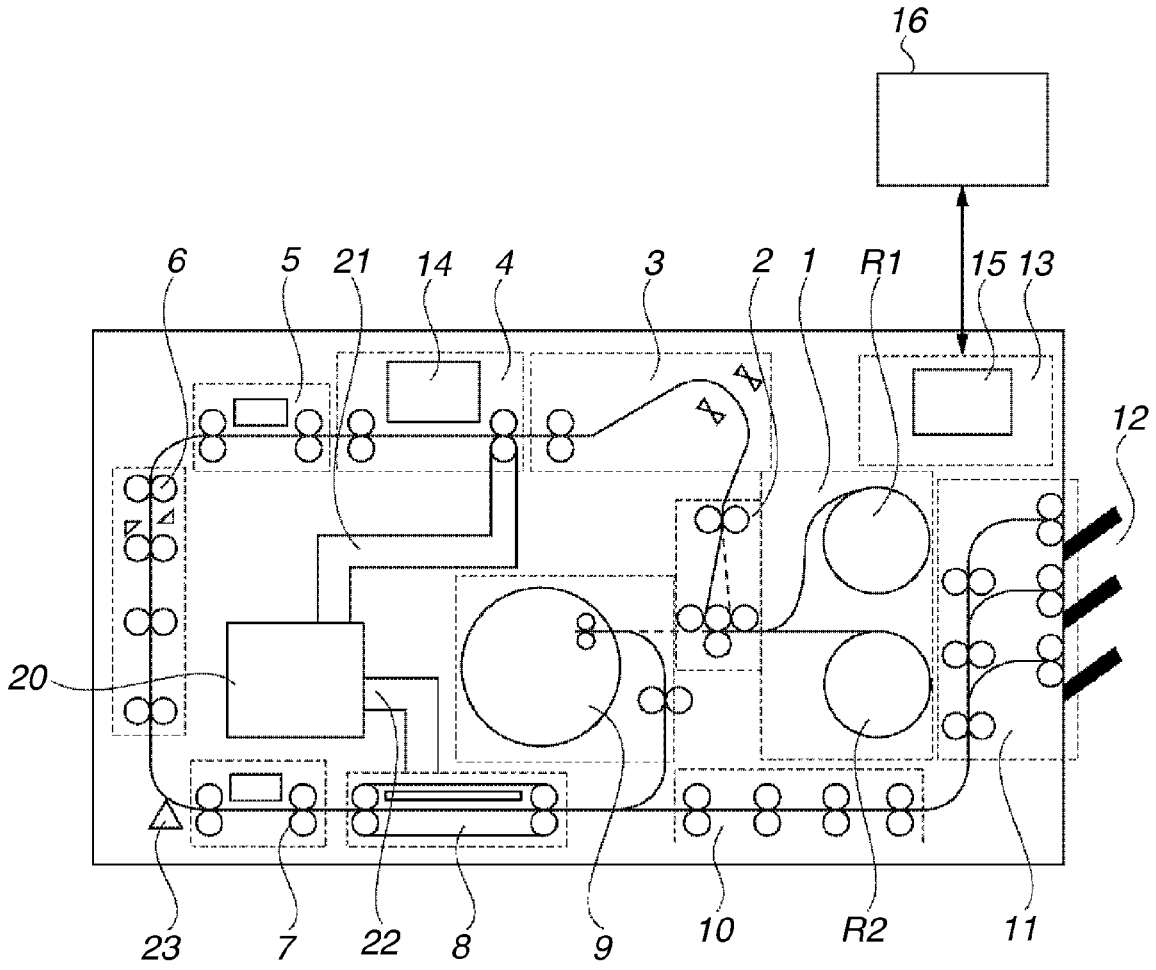
FIG. 1 schematically illustrates an internal configuration of a printing apparatus.

FIG. 1 is a sectional view schematically illustrating an internal configuration of the printing apparatus. The printing apparatus according to the present exemplary embodiment can print, by using a sheet wound in a roll shape, images on two sides, i.e., a first surface and a rear surface side of the first surface, of the sheet. The printing apparatus largely includes a sheet feeding unit 1, a decurling unit 2, a skew correction unit 3, a printing unit 4, an inspection unit 5, a cutter unit 6, an information recording unit 7, a drying unit 8, a reversing unit 9, a discharge conveyance unit 10, a sorter unit 11, a discharge unit 12, a humidification unit 20, and a control unit 13.

The sheet is conveyed on a sheet conveyance path indicated by a solid line illustrated in FIG. 1 by a conveyance mechanism that includes a roller pair and a belt to be processed at each unit. In an arbitrary position of the sheet conveyance path, a side near the sheet feeding unit 1 is referred to as an "upstream side", and its opposite side is referred to as a "downstream side".

The sheet feeding unit 1 holds and feeds a continuous sheet wound in a roll shape. The sheet feeding unit 1 can house two rolls R1 and R2, and selectively pulls out one of the rolls to feed it. The number of rolls that the sheet feeding unit 1 can house is not limited to two. The sheet feeding unit 1 may house only one or more than three.

The decurling unit 2 reduces curls (warps) of the sheet fed from the sheet feeding unit 1. The decurling unit 2 bends, using two pinch rollers with respect to one driving roller, the sheet in a direction (predetermined direction) for applying a warp of a curl opposite direction, and passes the sheet, thereby applying a decurling force. The decurling unit 2 thus reduces curls by this decurling force. The decurling unit 2 can adjust the decurling force.

The skew correction unit 3 corrects skewing (inclination with respect to a proper advancing direction) of the sheet passed through the decurling unit 2. The skew correction unit 3 corrects skewing of the sheet by pressing a sheet end of a reference side to a guiding member.

The printing unit 4 forms an image by performing printing on the conveyed sheet from above by a print head 14. In other words, the printing unit 4 is a processing unit that performs predetermined processing on the sheet. The printing unit 4 includes a plurality of conveyance rollers for conveying the sheet. The print head 14 includes a line-type print head on which a nozzle array of the ink-jet method is arranged within a range of covering a maximum width of a sheet assumed to be used.

The print head 14 includes a plurality of print heads arrayed in parallel in the conveying direction. In the present exemplary embodiment, the print head 14 includes seven print heads corresponding to seven colors of cyan (C), magenta (M), yellow (Y), light cyan (LC), light magenta (LM), gray (G), and black (K). The number of colors and the number of print heads are not limited to seven.

For the ink-jet method, a method using a heating element, a method using a piezoelectric element, a method using an electrostatic element, or a method using a microelectromechanical system (MEMS) element can be used. Ink of each color is fed from an ink tank to the print head 14 via an ink tube. As described below, in the printing unit 4, the print head 14 is movable in a retracting direction from the sheet. Thus, an interval of the print head 14 from the sheet is adjusted.

The inspection unit 5 optically reads, by a scanner, an inspection pattern or an image printed on the sheet by the printing unit 4, and inspects a nozzle state of the print head, a sheet conveyance state, or an image position to determine whether the image has been correctly printed. The scanner includes a charge coupled device (CCD) image sensor, or a complementary metal-oxide-semiconductor (CMOS) image sensor.

The cutter unit 6 includes a mechanical cutter for cutting the image-printed sheet to a predetermined length. The cutter unit 6 includes a plurality of conveyance rollers for delivering the sheet to a next step.

The information recording unit 7 records print information (unique information) such as a print serial number or date which is printed in an unprinted area of the cut sheet. The information recording unit 7 performs recording by printing a character or a code by the ink-jet method or the thermal transfer method.

A sensor 23 is disposed on the upstream side of the information recording unit 7 and on the downstream side of the cutter unit 6 to detect a leading edge of the cut sheet. More specifically, the sensor 23 detects the end of the sheet between the cutter unit 6 and the recording position of the information recording unit 7. Timing of information recording at the information recording unit 7 is controlled based on detection timing of the sensor 23.

The drying unit 8 heats the sheet on which the image has been printed by the printing unit 4 to dry the added ink within a short time. In the drying unit 8, hot air is applied to the passing sheet at least from a bottom surface side to dry an ink-added surface. The drying method is not limited to the hot air. A method for irradiating a sheet surface with an electromagnetic wave (ultraviolet ray or infrared ray) can be employed.

The sheet conveyance path from the sheet feeding unit 1 to the drying unit 8 is set as a first path. The first path has a U-turn shape between the printing unit 4 and the drying unit 8. The cutter unit 6 is located on the midway of the U-turn shape.

The reversing unit 9 temporarily takes up the continuous sheet on which surface-printing has been completed to reverse a front surface and a rear surface when two-sided printing is performed. The reversing unit 9 is located on the midway of a path (loop path) (set as a second path) set from the drying unit 8 through the decurling unit 2 to the printing unit 4 to feed the sheet passed through the drying unit 8 again to the printing unit 4. The reversing unit 9 includes a rotatable take-up rotor (drum) for taking up the sheet.

The continuous sheet completed with surface-printing but yet to be cut is temporarily taken up by the take-up rotor. After the continuous sheet has been taken up, the take-up rotor reversely rotates to feed the taken-up sheet to the decurling unit 2, and the sheet is then fed to the printing unit 4. This sheet has been reversed between the front surface and the rear surface, and hence the printing unit 4 can print an image on the rear surface. A more specific operation of the two-sided operation will be described below.

The discharge conveyance unit 10 conveys the sheet cut by the cutter unit 6 and dried by the drying unit 8 to pass it to the sorter unit 11. The discharge conveyance unit 10 is disposed on a path (set as a third path) different from the second path that includes the reversing unit 9. To selectively guide the sheet conveyed on the first path to one of the second path and the third path, a path switching mechanism having a movable flapper is disposed in a path branch position.

The sorter unit 11 and the discharge unit 12 are disposed on the side of the sheet feeding unit 1 and at a tail end of the third path. The sorter unit 11 sorts printed sheets into groups when necessary. The sorted sheets are discharged to the discharge unit 12 that includes a plurality of trays. Thus, the third path is laid out so that the sheet can be passed below the sheet feeding unit 1, and discharged to aside opposed to the printing unit 4 and the drying unit 8 across the sheet feeding unit 1.

As described above, the units from the sheet feeding unit 1 to the drying unit 8 are sequentially arranged on the first path. The units after the drying unit 8 are branched to the second path and the third path. The reversing unit 9 is disposed on the midway of the second path, and the path after the reversing unit 9 joins the first path. The discharge unit 12 is located at the tail end of the third path.

The humidification unit 20 generates humidified gas (air) to supply it between the print heat 14 of the printing unit 4 and the sheet. The humidified gas can suppress ink drying on the nozzles of the print head 14. For a humidification method of the humidification unit 20, a method such as vaporization, water spraying or steaming can be employed. The vaporization includes, in addition to a rotation method of the present exemplary embodiment, a moisture permeable membrane method, a drop permeation method, and a capillary method. The water spraying includes an ultrasonic method, a centrifugal method, a high-pressure spray method, and a double-fluid spray method. The steaming includes a steam pipe method, an electrothermal method, and an electrode method.

The humidification unit 20 and the printing unit 4 are interconnected via a first duct 21, and the humidification unit 20 and the drying unit 8 are interconnected via a second duct 22. In the drying unit 8, highly humid and high-temperature gas is generated to dry the sheet. The gas is introduced through the second duct 22 to the humidification unit 20. The humidification unit 20 uses the gas as auxiliary energy to generate humidified gas. The humidified gas generated by the humidification unit 20 is introduced through the first duct 21 to the printing unit 4.

The control unit 13 controls each unit of the entire printing apparatus. The control unit 13 includes a central processing unit (CPU), a storage device, a controller including various control units, an external interface, and an operation unit 15 operated by a user to input and output data. An operation of the printing apparatus is controlled based on a command from the controller or a host apparatus 16 such as a host computer connected to the controller via the external interface.

Figure 2:
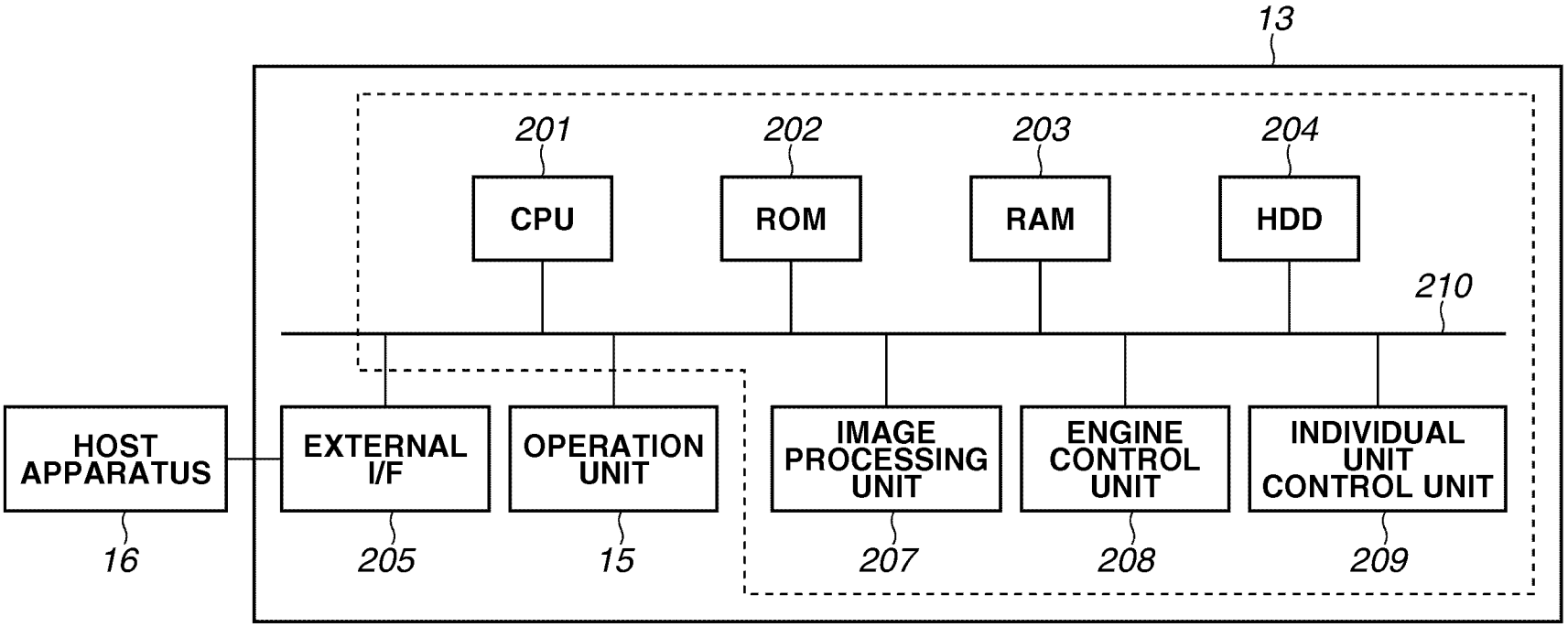
FIG. 2 is a block diagram illustrating a control unit.

FIG. 2 is a conceptual block diagram illustrating the control unit 13. The controller (range surrounded with broken line) includes a CPU 201, a read-only memory (ROM) 202, a random access memory (RAM) 203, a hard disk drive (HDD) 204, an image processing unit 207, an engine control unit 208, and an individual unit control unit 209.

The CPU 201 controls operations of the respective units of the printing apparatus in an integrated manner. The ROM 202 stores a program executed by the CPU 201 or fixed data necessary for various operations of the printing apparatus. The RAM 203 is used as a work area for the CPU 201, as a temporary storage area for various received data pieces, or as an area for storing various setting data pieces. The HDD 204 can store or read out the program executed by the CPU 201, print data, or setting information necessary for various operations of the printing apparatus. The operation unit 15 is an input/output interface with the user, and includes an input unit such as a hard key or a touch panel, and an output unit such as a display or an audio generator for presenting information.

For a unit required to perform high-speed processing, a dedicated processing unit is provided. The image processing unit 207 performs image processing of print data handled in the printing apparatus. The image processing unit 207 converts a color space (e.g., YCbCr) of input image data into a standard RGB color space (e.g., sRGB). The image processing unit 207 performs various types of image processing such as resolution conversion, image analysis, and image correction for the image data when necessary. The pieces of the print data acquired by such image processing are stored in the RAM 203 or the HDD 204.

The engine control unit 208 drives and controls the print head 14 of the printing unit 4 according to the print data based on a control command received from the CPU 201. The engine control unit 208 further controls a conveyance mechanism of each unit in the printing apparatus.

The individual unit control unit 209 is a sub-controller for individually controlling the sheet feeding unit 1, the decurling unit 2, the skew correction unit 3, the inspection unit 5, the cutter unit 6, the information recording unit 7, the drying unit 8, the reversing unit 9, the discharge conveyance unit 10, the sorter unit 11, the discharge unit 12, and the humidification unit 20. The individual control unit 209 controls an operation of each unit based on a command from the CPU 201.

The external interface 205 is an interface (I/F), i.e., a local I/F or a network I/F, for connecting the controller to the host apparatus 16. The above described components are interconnected via a system bus 210.

The host apparatus 16 is a supply source of image data for causing the printing apparatus to perform printing. The host apparatus 16 can be a general-purpose computer or a dedicated computer or a dedicated image device such as an image capture unit, a digital camera or a photo-storage that includes an image reader portion. When the host apparatus 16 is a computer, an operating system (OS), application software for generating image data, and a printing apparatus driver for the printing apparatus are installed into a storage device included in the computer. It is not essential to realize all the processes by software. Some parts or all the processes can be realized by hardware.

Next, a basic operation during printing will be described. Printing operations are different between the one-sided printing mode and the two-sided printing mode, and thus each will be described.

Figure 3:
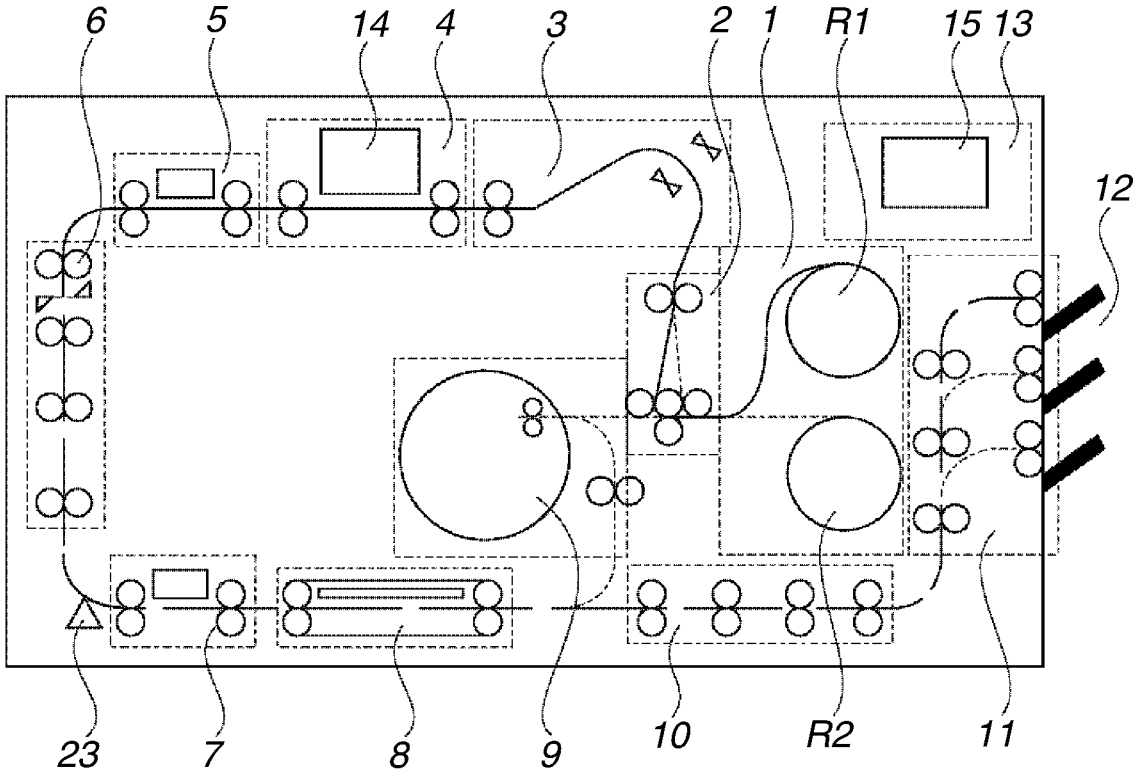
FIG. 3 illustrates an operation in a one-sided printing mode.

FIG. 3 illustrates the operation in the one-sided printing mode. In FIG. 3, a conveyance path from printing of a sheet fed from the sheet feeding unit 1 to its discharging to the discharge unit 12 is indicated by a heavy line.

The printing unit 4 performs printing on a front surface (first surface) of the sheet fed from the sheet feeding unit 1 and processed at the decurling unit 2 and the skew correction unit 3. The printing unit 4 sequentially prints images each having a predetermined unit length (unit images) on the long continuous sheet in the conveying direction to array and form a plurality of images. The printed sheet is passed through the inspection unit 5, and cut for each unit image by the cutter unit 6. When necessary, the information recording unit 7 records the print information on rear surfaces of the cut sheets.

The cut sheets are conveyed one by one to the drying unit 8 to be dried. The cut sheets are then passed through the discharge conveyance unit 10, and sequentially discharged to the discharge unit 12 of the sorter unit 11 to be stacked. On the other hand, a sheet left on the printing unit 4 side after cutting of the last unit image is fed back to the sheet feeding unit 1 to be taken up on the roll R1 or R2. As described below, while the sheet is fed back, a decurling force of the decurling unit 2 is adjusted to be small, and the print head 14 retracts from the sheet.

Thus, in the one-sided printing, the sheets are passed through the first path and the third path to be processed, but not passed through the second path. To summarize, in the one-sided printing mode, a sequence of #1 to #6 below is executed under control of the control unit 13:

#1 a sheet is fed from the sheet feeding unit 1 to the printing unit 4;

#2 the printing unit 4 repeatedly prints the unit images on a first surface of the fed sheet;

#3 the cutter unit 6 repeatedly cuts the sheet for the respective unit images printed on the first surface;

#4 the sheets cut for the respective unit images are passed one by one through the drying unit 8;

#5 the sheets passed one by one through the drying unit 8 are passed through the third path to be discharged to the discharge unit 12; and

#6 a sheet left on the printing unit 4 side after cutting of the last unit image is fed back to the sheet feeding unit 1.

Figure 4:
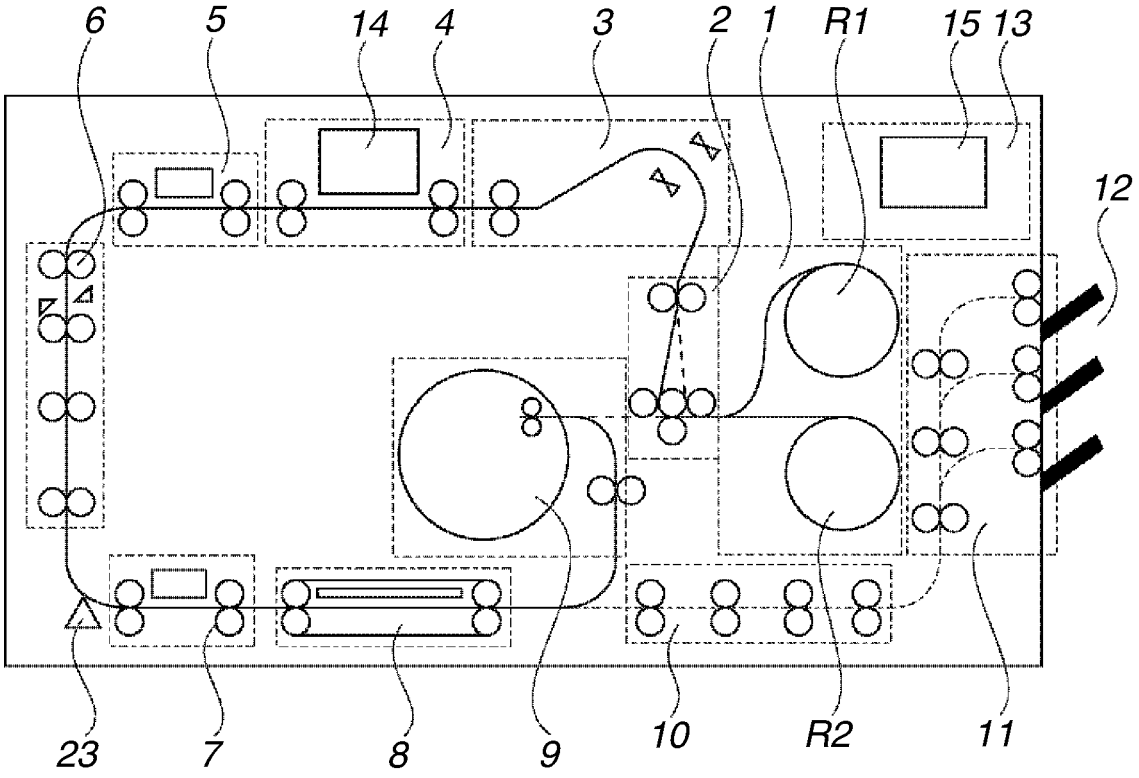
FIG. 4 illustrates an operation in a two-sided printing mode.
Figure 5:
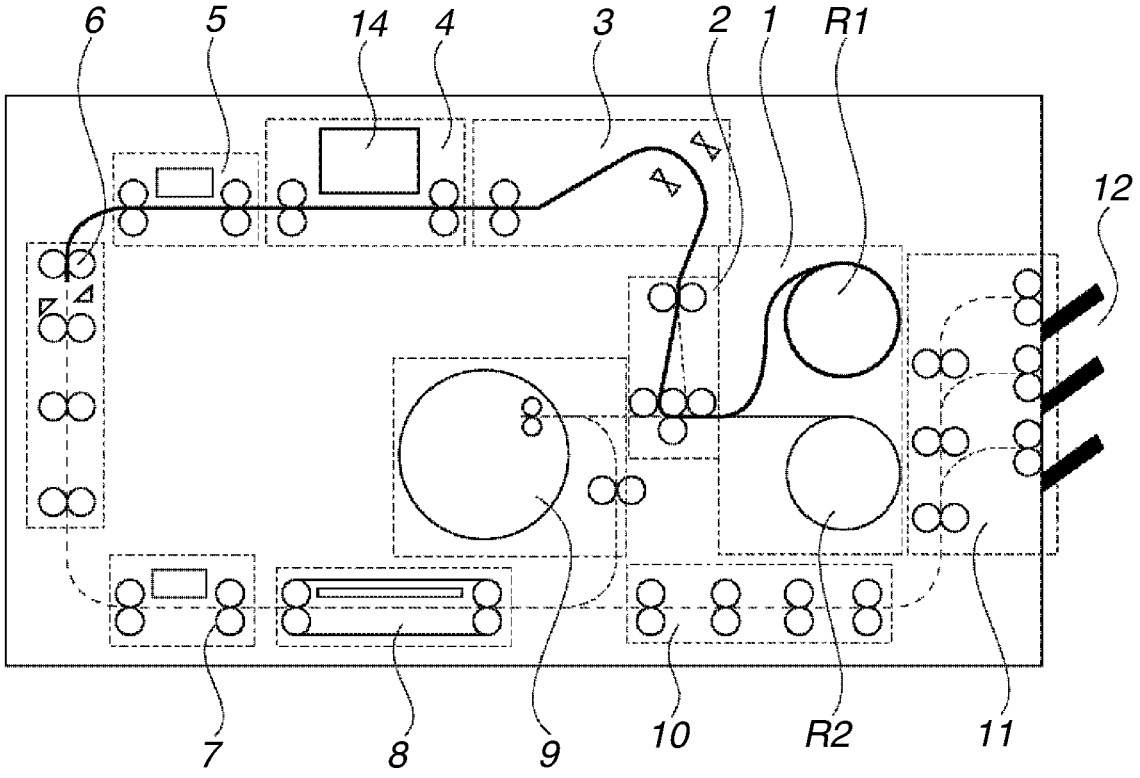
FIG. 5 illustrates a state immediately before a sheet is cut and started to be fed back.

FIG. 4 illustrates the operation in the two-sided printing mode. In the two-sided printing mode, a rear-surface (second surface) printing sequence is executed subsequent to a front-surface (first surface) printing sequence. In the first front-surface printing sequence, operations of the units from the sheet feeding unit 1 to the inspection unit 5 are similar to those in the case of the one-sided printing mode.

The cutter unit 6 performs no cutting operation, and the sheet is conveyed as a continuous sheet to the drying unit 8. After ink drying of the front surface at the drying unit 8, the sheet is guided not to the path (third path) of the discharge conveyance unit 10 side but to the path (second path) of the reversing unit 9 side. On the second path, the take-up rotor of the reversing unit 9 rotated in a forward direction (anticlockwise in FIG. 4) takes up the sheet. At the printing unit 4, after completion of all scheduled front-surface printing, the cutter unit 6 cuts rear ends of printed areas of the continuous sheet.

With a cutting position set as a reference, the continuous sheet on the downstream side (printed side) in the conveying direction is passed through the drying unit 8, and completely taken up to the sheet rear end (cutting position) by the reversing unit 9. On the other hand, simultaneously with taking-up by the reversing unit 9, the continuous sheet left on the upstream side (printing unit 4 side) of the cutting position in the conveying direction is fed back to the sheet feeding unit 1 not to leave the sheet leading end (cutting position) in the decurling unit 2, and then taken up on the roll R1 or R2. The feeding-back (back feeding) can prevent collision with the sheet fed again in the rear-surface printing sequence below. As described below, while the sheet is fed back, the decurling force of the decurling unit 2 is adjusted to be small, and the print head 14 retracts from the sheet.

The processing is switched to the rear-surface printing sequence after the front-surface printing sequence. The take-up rotor of the reversing unit 9 rotates in a direction (clockwise in FIG. 4) reverse to that during the taking-up. The end of the taken-up sheet (sheet rear end during the taking-up becomes a sheet leading end during feeding) is fed on the path indicated by the broken line in FIG. 4 into the decurling unit 2. The decurling unit 2 corrects curls added by the take-up rotor. More specifically, the decurling unit 2 is disposed between the sheet feeding unit 1 and the printing unit 4 on the first path and between the reversing unit 9 and the printing unit 4 on the second path. In both paths, the decurling unit 2 is a common unit that performs decurling.

The sheet reversed between the front surface and the rear surface is passed through the skew correction unit 3, and fed to the printing unit 4. Images are then printed on the rear surface of the sheet. The printed sheet is passed through the inspection unit 5, and the cutter unit 6 cuts the sheet for each predetermined unit length that has been set beforehand. The images have been printed on two sides of the cut sheet, and thus the information recording unit 7 does not record data. The cut sheets are conveyed one by one to the drying unit 8, and sequentially discharged through the discharge conveyance unit 10 to the discharge unit 12 of the sorter unit 11 to be stacked.

As described above, in the two-sided printing, the sheet is sequentially passed through the first path, the second path, the first path, and the third path to be processed. To summarize, in the two-sided printing mode, a sequence of #1 to #11 below is executed under control of the control unit 13:

#1 a sheet is fed from the sheet feeding unit 1 to the printing unit 4;

#2 the printing unit 4 repeatedly prints the unit images on a first surface of the fed sheet;

#3 the sheet having the unit images printed on the first surface is passed through the drying unit 8;

#4 the sheet passed through the drying unit 8 is guided through the second path to be taken up by the take-up rotor of the reversing unit 9;

#5 after completion of the repeated printing on the first surface, the cutter unit 6 cuts the sheet behind the last printed unit image;

#6 the take-up rotor takes up the sheet until the end of the cut sheet passes through the drying unit 8 to reach the take-up rotor, and a sheet cut and left in the printing unit 4 side is fed back to the sheet feeding unit 1;

#7 after completion of the taking-up, the take-up rotor reversely rotates to feed the sheet through the second path again to the printing unit 4;

#8 the printing unit 4 repeatedly prints the unit images on a second surface of the sheet fed through the second path;

#9 the cutter unit 6 repeatedly cuts the sheet for the respective unit images printed on the second surface;

#10 the sheets cut for the respective unit images are passed one by one through the drying unit 8; and

#11 the sheets passed one by one through the drying unit 8 are passed through the third path to be discharged to the discharge unit 12.

Figure 6A:
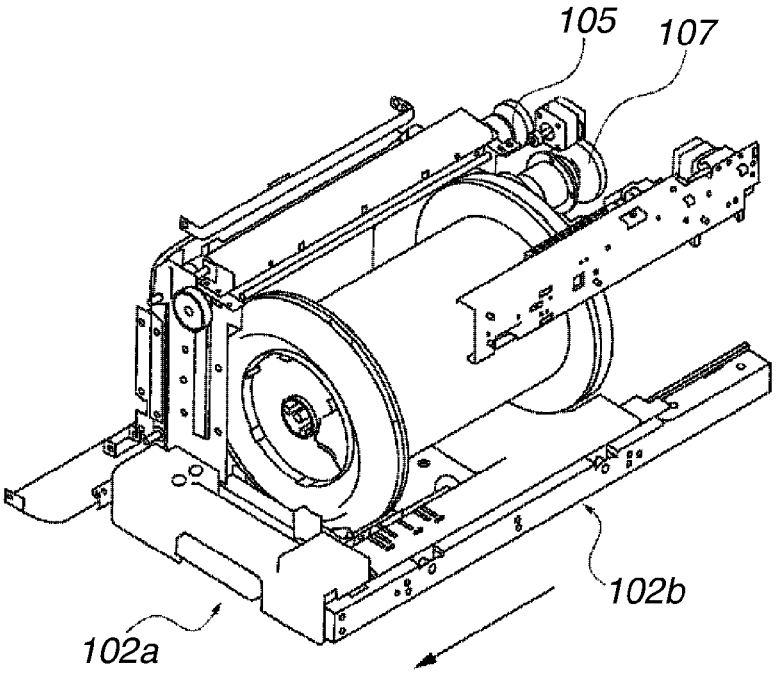
FIGS. 6A and 6B illustrate a configuration and an operation of a sheet feeding unit.
Figure 6B:
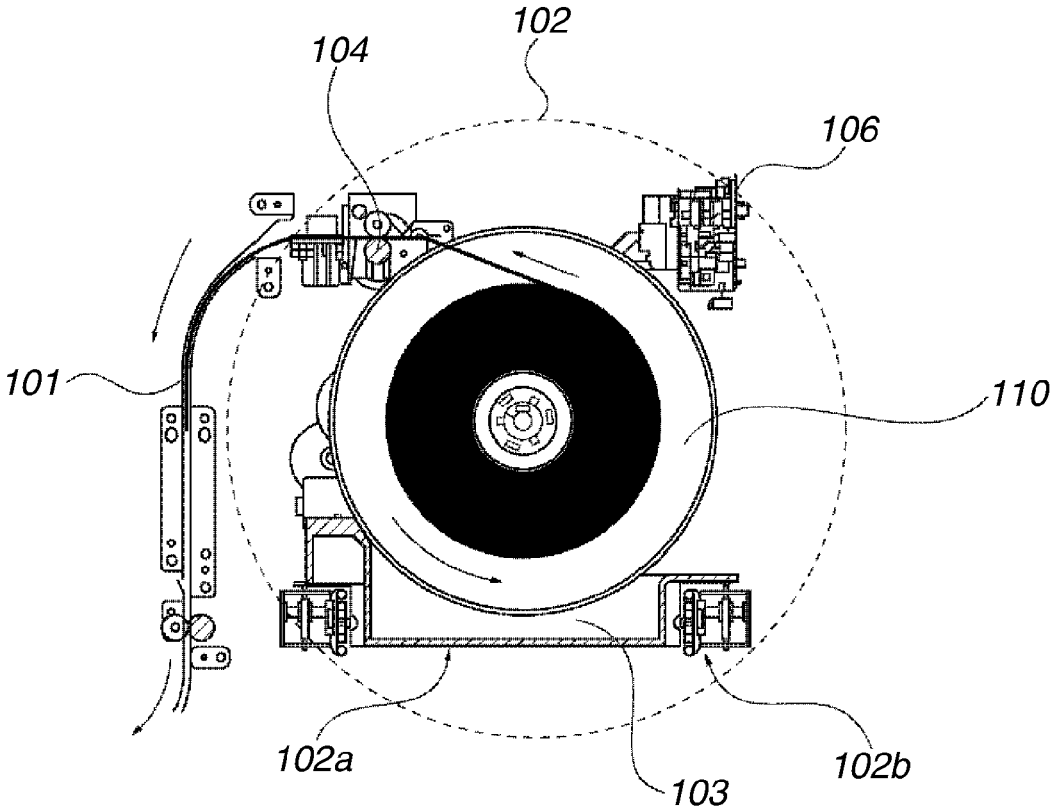

FIGS. 6A and 6B illustrate a configuration and an operation of the sheet feeding unit 1. The sheet feeding unit 1 houses a continuous sheet wound in a roll shape, and feeds the sheet to a sheet conveyance path 101 connected to the printing unit 4. FIG. 6A is a perspective view illustrating the sheet feeding unit 1, and FIG. 6B is a sectional view illustrating the sheet feeding unit 1. A sheet housing unit 102 includes a flange holding member 103, a sheet feeding roller pair 104, a sheet feeding roller driving unit 105 that transmits driving to the sheet feeding roller pair 104, a detection mechanism unit 106 that detects a sheet type and a sheet width, and a roll driving unit 107 that rotates a roll.

Figure 12A:
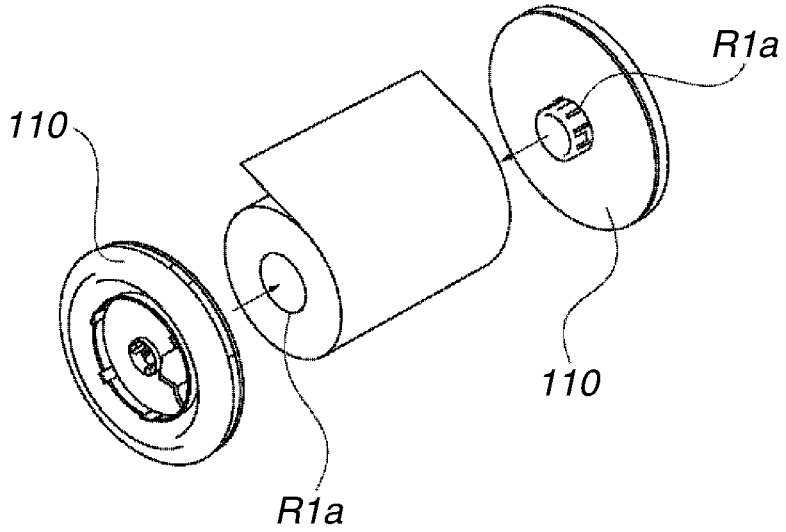
FIGS. 12A and 12B illustrate a state where the holding flanges are fitted to a sheet wound in a roll shape.

Next, a configuration for supporting a continuous roll sheet R1 in the sheet housing unit will be described. As illustrated in FIG. 12A, shafts 118 of a holding flange 110 are inserted from both ends of a core tube R1*a* of the continuous roll sheet R1, and the core tube R1*a* is fixed to the shafts 118 by using a roll core tube locking member 117 described below.

Figure 8A:
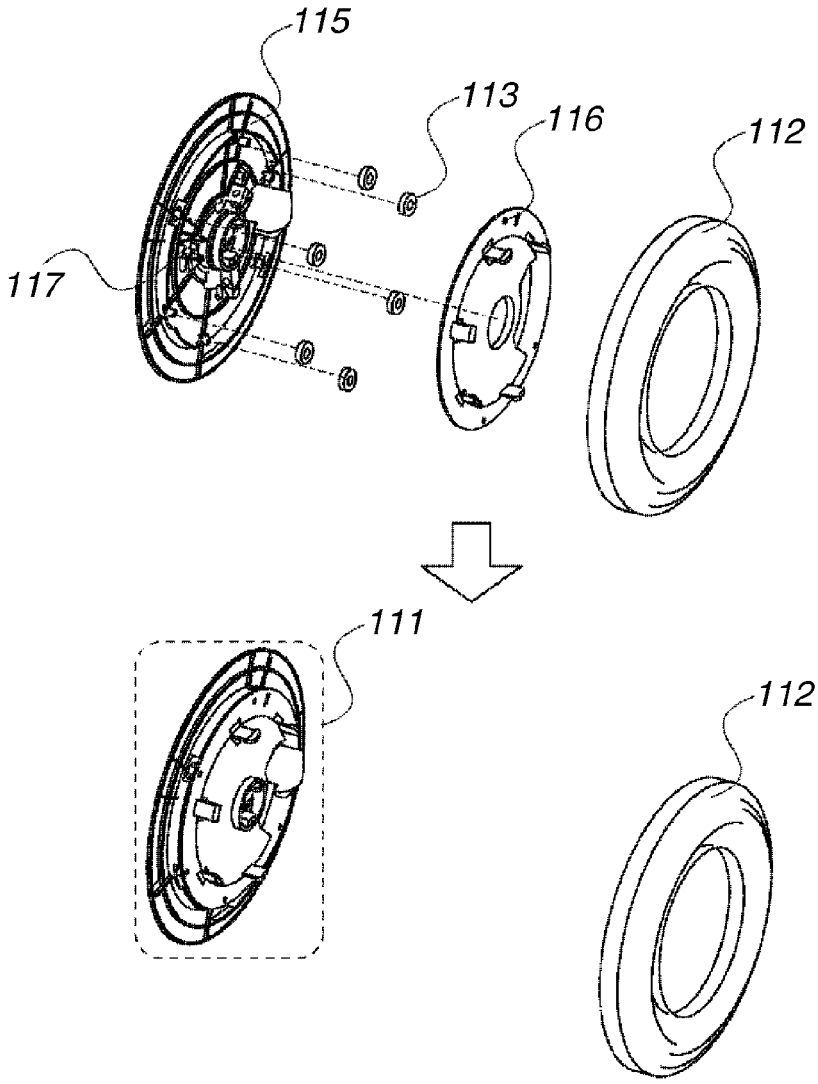
FIGS. 8A and 8B illustrate a configuration of a holding flange.
Figure 8B:
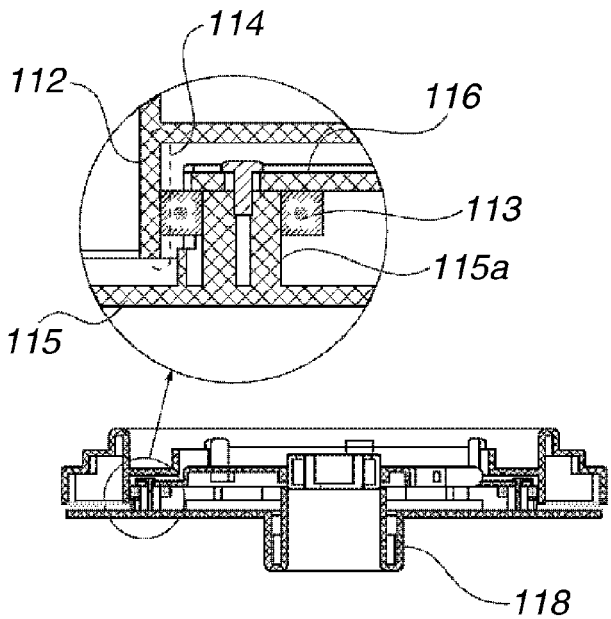

FIGS. 8A and 8B illustrate a configuration of the holding flange 110. FIG. 8A illustrates an internal configuration of the holding flange 110. FIG. 8B is a section view of the holding flange 110. The holding flange 110 includes a flange fixing unit 112 fixed to the flange holding member 103, and a flange rotation unit 111 rotatable with respect to the flange fixing unit 112. The flange rotation unit 111 includes a flange member 115 having the shaft 118 fitted to the core tube of the continuous sheet wound in the roll shape, and a plurality of bearings 113 for rotatably supporting the flange member 115 with respect to the flange fixing unit 112.

The continuous sheet wound in the roll shape can be rotated by fixing the continuous sheet wound in the roll shape to the shafts 118 serving as rotary shafts of the flange rotation unit 111 and transmitting driving from the roll driving unit 107 to the flange rotation unit 111. The plurality of ring-shaped bearings 113 is rotatably supported by a plurality of shaft portions 115*a* disposed in the flange member 115. A bearing cover 116 prevents the plurality of bearings 113 from pulling out. The plurality of bearings 113 rolls into contact with an inner circumferential sliding surface 114 of the flange fixing unit 112. Thus, when the sheet is fed, the continuous roll sheet smoothly rotates. The plurality of bearings 113 supports the roll with respect to the flange fixing unit 112, and disperses a load of roll weight.

Figure 9A:
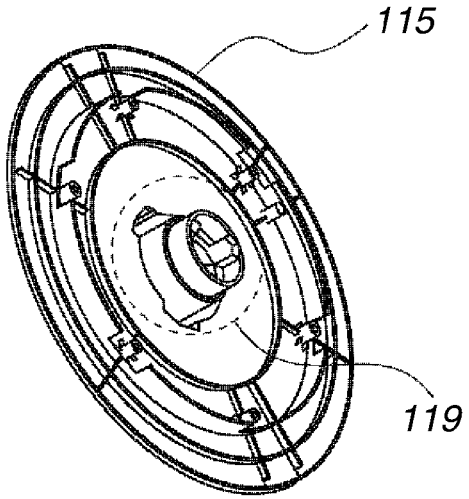
FIGS. 9A and 9B illustrate a configuration of a flange member.
Figure 9B:
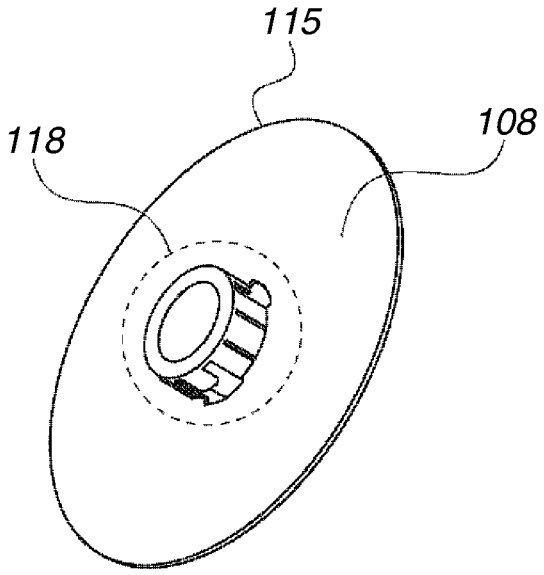

FIGS. 9A and 9B illustrate a configuration of the flange member 115. FIG. 9A illustrates an engagement side that receives transmitted driving, and FIG. 9B illustrates a roll side that supports the roll sheet. The roll side of the flange member 115 includes the shaft 118 inserted into the core tube of the roll, and a guide surface 108 for guiding the sheet end. The engagement side that receives the transmitted driving includes a coupling 119 serving as a driven unit to which the driving from the roll driving unit 107 is transmitted, attachment portions of the bearing 113 and the bearing cover 116, an attachment portion of the roll core tube locking member 117.

Figure 10A:
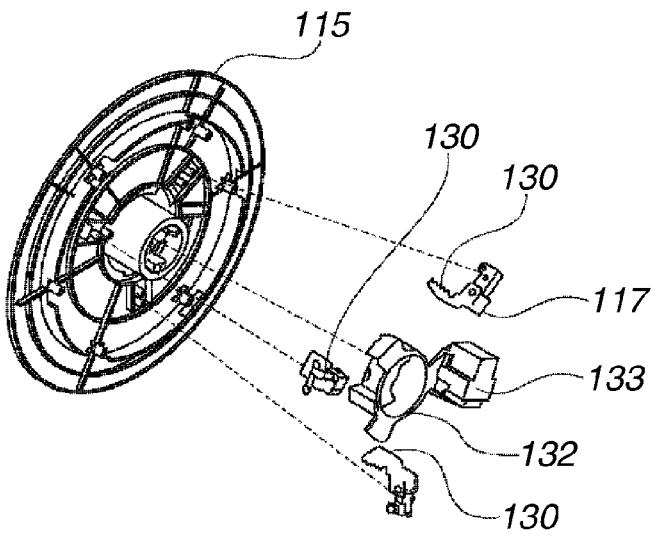
FIGS. 10A to 10D illustrate a configuration of fixing the holding flange and a roll together.

FIGS. 10A to 10D illustrate a configuration for fixing the holding flange 110 and the roll together. FIG. 10A illustrates a layout of the roll core tube locking member 117 attached to the flange member 115. The roll core tube locking member 117 includes a holding portion 117*a* held by the flange member, and a plate member 130 movably supported on the holding portion 117*a*. Both-side ends of the plate member 130 are bent and raised to form sawtooth-like serrated portions 130*a*.

Figure 10B:
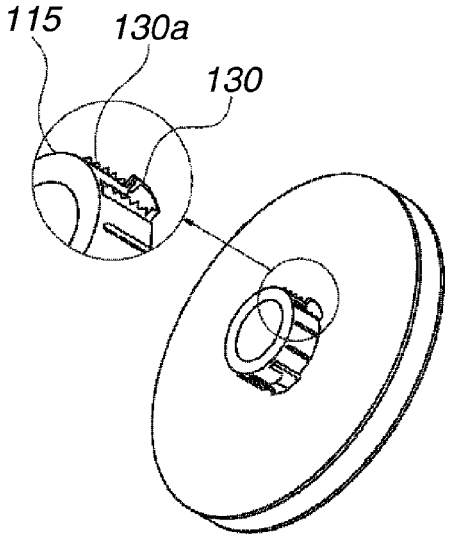

FIG. 10B is a perspective view illustrating the roll side of the holding flange 110. A slit extending in an axial direction is formed to in an outer circumference of the shaft 118 of the flange member 115. The serrated portion 130*a* of the plate member 130 protrudes through the slit to the outer circumference of the shaft 118.

Figure 10C:
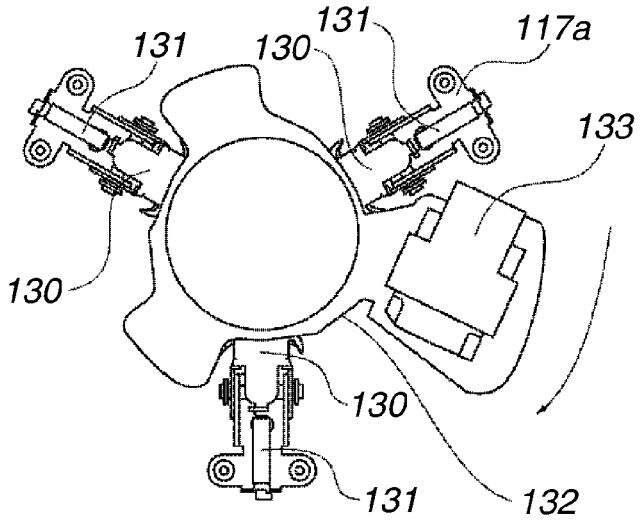
Figure 10D:
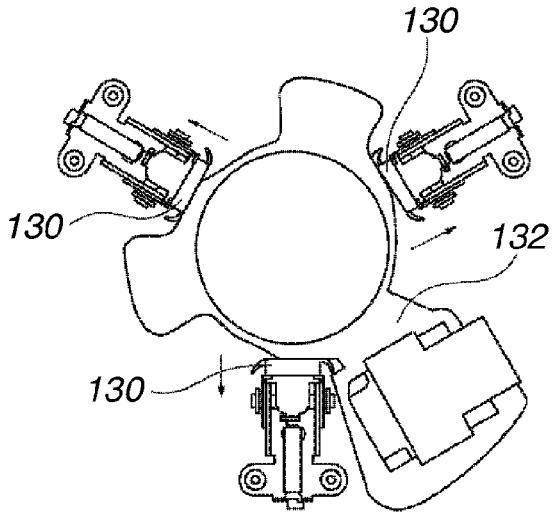

When the shaft 118 is fitted into the core tube of the roll sheet, and the roll core tube locking member 117 is moved from an unlocking position to a locking position, the core tube is fixed to the shaft 118. FIG. 10C illustrates a state where the roll core tube locking member 117 is located in the unlocking position. FIG. 10D illustrates a state where the roll core tube locking member 117 is located in the locking position.

The plate member 130 of the roll core tube locking member 117 is movably supported on the holding portion 117*a* held by the flange member. The plate member 130 is disposed inside the shaft 118, and a cam 132 is disposed inside the plate member 130. A spring 131 urges the plate member 130 so that a surface of the plate member 130 on the center side of the shaft 118 can press the cam 132. When the shaft 118 is inserted into the core tube of the roll sheet in the unlocking position illustrated in FIG. 10C, the shaft 118 and the core tube are fitted together with play.

When an operation unit 133 of the cam 132 rotates the cam 32 in an arrow direction illustrated in FIG. 10C, a large-diameter portion of the cam 132 radially expands the three plate members 130 in arrow directions illustrated in FIG. 10D against an urging force of the spring 131. The serrated portion 130*a* having a sharp leading edge further protrudes from the slit of the shaft 118, and bites into the inner circumferential surface of the core tube of the roll sheet, thereby setting a locked state where the core tube is fixed to the shaft 118.

Figure 11A:
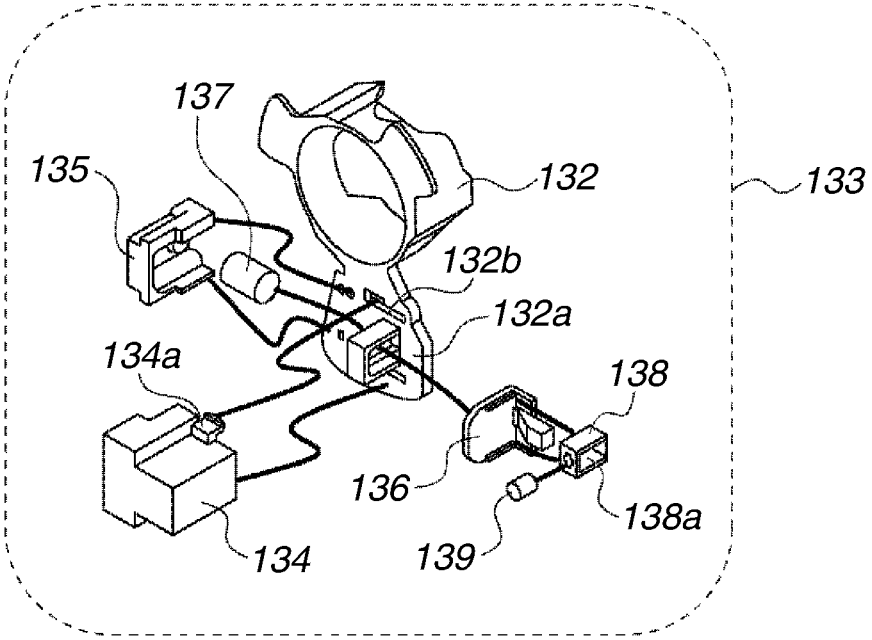
FIGS. 11A to 11C illustrate a configuration and an operation of an operation unit that fixes the holding flange and the roll together.
Figure 11B:
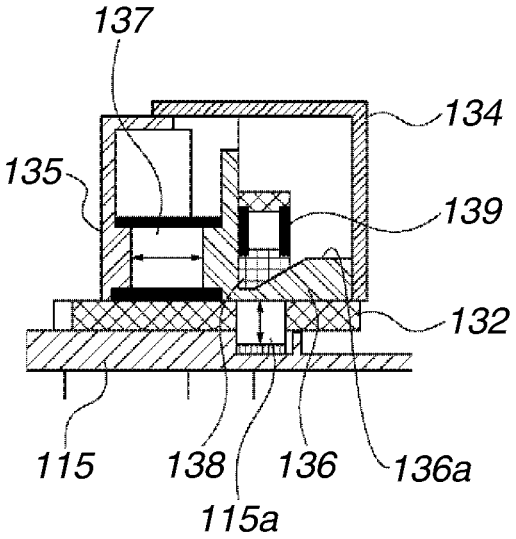
Figure 11C:
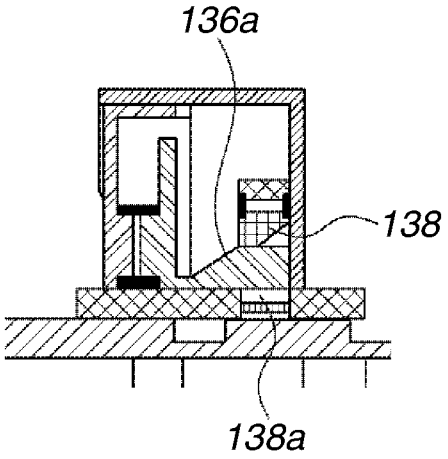

FIGS. 11A to 11C illustrate a configuration and an operation of the operation unit 133 that rotates the cam 132. FIG. 11A illustrates the configuration of the operation unit 133. FIG. 11B illustrates a state where the operation unit 133 is fixed to the flange member 115. FIG. 11C is a section view illustrating a state where the operation unit 133 is not fixed to the flange member 155, and thus can rotate the cam 132.

The cam 132 includes a lever 132*a* formed to extend in a radial direction of the shaft 118. A first gripping member 135 is fixed to the lever 132*a*. A claw 134*a* formed in a second gripping member 134 engages with a groove 132*b* formed in the lever 132*a* to attach the second gripping member 134 slidably to the lever 132*a*. A locking member 138 can protrude from the lever 132*a* to the flange member 115 side or retract therefrom.

FIG. 11B illustrates a state where the locking member 138 protrudes from the lever 132*a* to be located in the locking position. The protruded locking member 138 engages with a groove 115*a* of the flange member 115, so that the lever 132*a* is fixed to the flange member 115. A lock spring 139 urges the locking member 138 in a protruding direction. A lock slider spring 137 disposed between the first gripping member 135 and a lock slider 136 urges the lock slider 136 in a direction for maintaining its position illustrated in FIG. 11B.

FIG. 11C illustrates a state where the locking member 138 retracts to the unlocking position to enable rotation of the lever 132*a*. The locking member 138 is moved to the unlocking position by a cam 136*a* formed in the lock slider 136. The lock slider 136 is slidably held by the lever 132*a*, and the cam 136*a* is put through a hole 138*a* of the locking member 138. When the second gripping member 134 is moved toward the first gripping member 135, the lock slider 136 moves integrally with the second gripping member 134.

Moving the second gripping member 134 toward the first gripping member 135 enables the lock slider 136 to slide from the position illustrated in FIG. 11B to the left against an urging force of the lock slider spring 137. After the lock slider 136 has been moved left, as illustrated in FIG. 11C, the cam 136*a* pushes up an upper surface of the hole 138*a* of the locking member 138, and the locking member 138 moves to the retracted unlocking position.

When the first gripping member 135 and the second gripping member 134 are pinched by fingers, the second gripping member 134 and the lock slider 136 are moved, so that the locking member 138 can be moved to the unlocking position. In this state, the lever 132 is rotated. When the locking member 138 moves to a position to be able to engage with another groove, the first gripping member 135 and the second gripping member 134 are released. The lock slider 136 is accordingly returned by the lock slider spring 137. The locking member 138 is moved to the locking position by the lock spring 139 to be fitted into the groove.

Figure 12B:
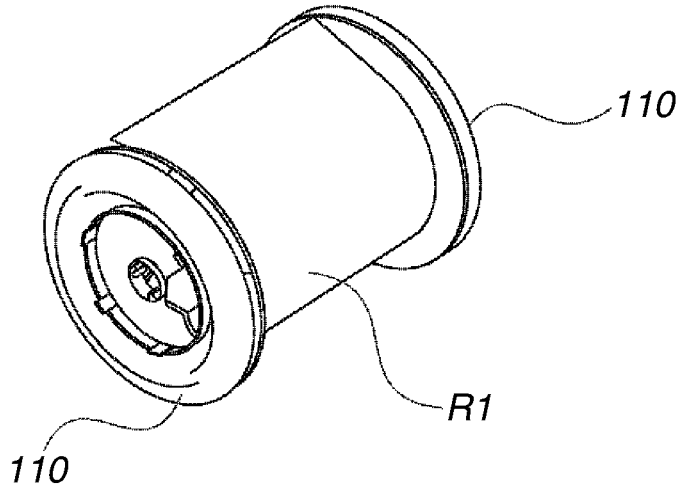

FIG. 12B illustrates a state where the shafts 118 of the holding flanges 110 are inserted from both ends of the core tube R1*a* of the continuous roll sheet R1, and the core tube R1*a* is fixed to the shafts 118 using the roll core tube locking member 117. The two holding flanges 110 for holding both ends of the continuous roll sheet R1 are similarly configured, and can fit to the continuous roll sheet R1 irrespective of a roll winding direction.

The holding flange 110 has a circular outer-diameter shape, and can be loaded at an arbitrary phase with respect to a phase of the roll or with respect to the flange holding member 103. The holding flange 110 may have a polygonal outer-diameter shape. Even in that case, the holding flange 110 can be loaded without adjusting any phase, and when the continuous roll sheet having the holding flanges 110 loaded thereon is placed outside the printing apparatus, rolling or falling can be prevented.

The continuous roll sheet R1 having the holding flanges 110 loaded on both ends is held by the flange holding member 103 disposed in the sheet feeding unit 1.

Figure 7A:
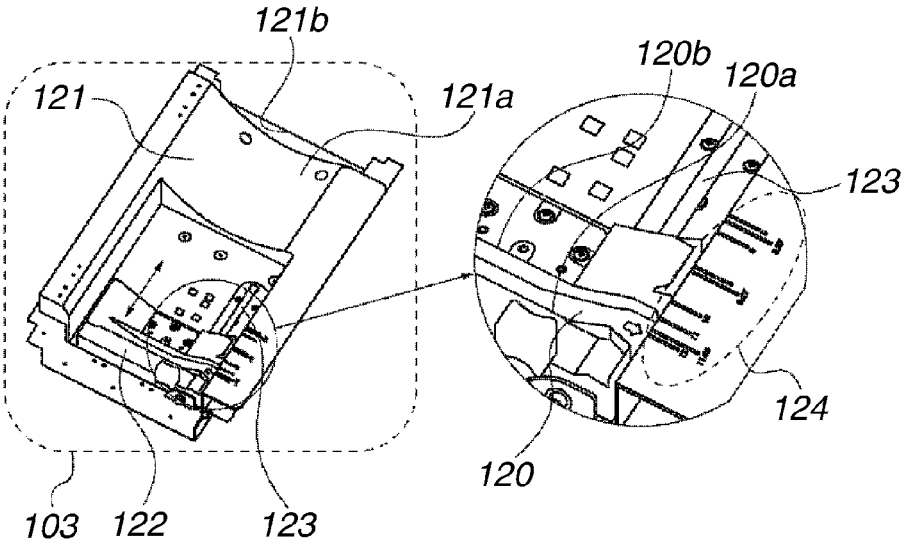
FIGS. 7A to 7C illustrate a configuration and an operation of a flange holding member.
Figure 7B:
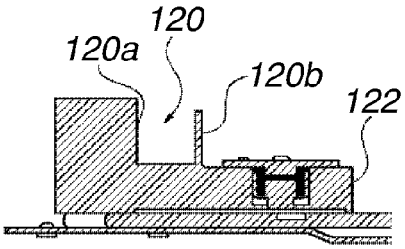
Figure 7C:
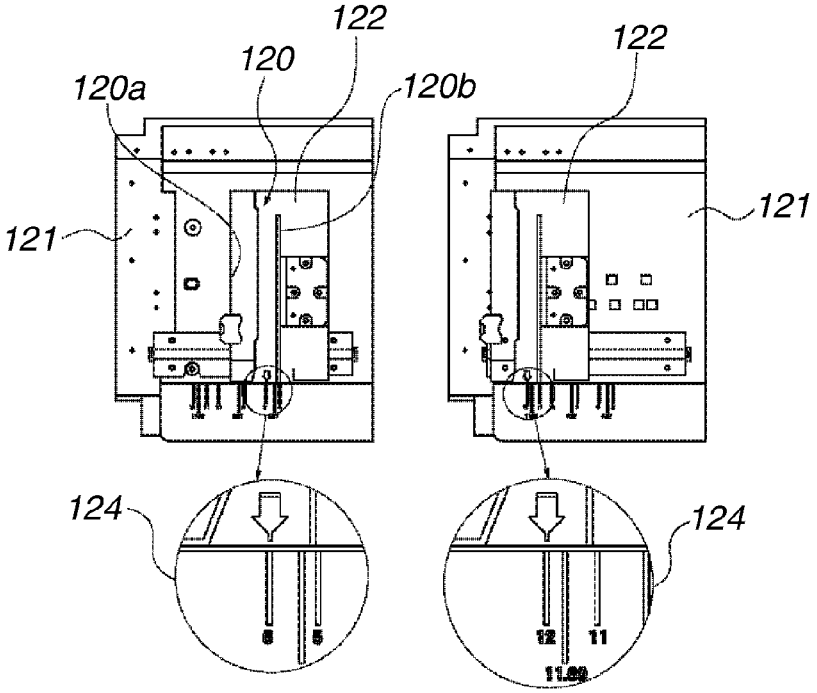

FIGS. 7A to 7C illustrate a configuration and an operation of the flange holding member 103. In FIG. 7A, a flange holder 121 holds the continuous roll sheet R1 together with the holding flanges 110. The flange holder 121 includes a groove 121*a* formed to be circular arc in section, into which the continuous roll sheet R1 is dropped together with the holding flanges 110. In one end of the flange holder 121, a position regulation surface 121*b* is formed that abuts on one holding flange 110 to regulate its position.

Dropping the holding flange 110 into the circular-arc groove 121*a* regulates movement of the holding flange 110 in a direction for intersecting the shaft 118 that is a rotary shaft of the holding flange 110. A position of the other holding flange 110 is regulated by a flange positioning holder 122. The flange positioning holder 122 is slidably disposed along an axis 123 parallel to an axis of the continuous roll sheet held on the flange holder 121.

FIG. 7B illustrates a section view of the flange positioning holder 122 cut on a plane parallel to the axis of the continuous roll sheet. The flange positioning holder 122 includes a groove 120 formed by a rib 120*b*. An inner surface of the groove 120 is a movable side position regulation surface 120*a* that abuts on the holding flange 110 to regulate its position. The flange holder 121 includes a display unit 124 that displays a sheet width. The flange positioning holder 122 can stop at a position of the sheet width displayed by the display unit 124.

The flange holder 121 and the flange positioning holder 122 have groove shapes recessed into circular-arc shapes, and abut on an outer circumferential portion of the holding flange 110 to support it. The flange positioning holder 122 includes the groove 120 formed in a direction orthogonal to the axial direction of the continuous sheet wound in the roll shape. The groove 120 presses the holding flange 110 to prevent its movement when a pressing force is applied on the loaded holding flange 110 in the axial direction.

A depth of the groove 120 is smaller than a difference between an outer diameter of the holding flange 110 and a maximum outer diameter of the continuous sheet wound in the roll shape. The groove 120 pinches the holding flange 110 between the movable side position regulation surface 120*a* and the rib 120*b* to prevent the holding flange 110 from rotating. The holding flange 110 has its position in the direction of the shaft 118, i.e., the rotary shaft, regulated by the position regulation surface 121*b*, the movable side position regulation surface 120*a*, and the rib 120*b*.

The flange holding member 103 and the sheet feeding roller pair 104 integrally constitute a sheet feeding unit 102*a*. The sheet feeding unit 102*a* is supported on a guide rail 102*b* so that it can be pulled out from an apparatus body. A pulling-out direction indicated an arrow illustrated in FIG. 6A is the same as that of the rotary shaft of the housed continuous roll sheet.

When the continuous roll sheet R1 is loaded on the sheet feeding unit 1, the holding flanges 110 are loaded on both ends of the continuous roll sheet R1. The sheet feeding unit 102*a* is pulled out from the printing apparatus, and the flange positioning holder 122 of the flange holder 121 is moved to a position matching a sheet size. The continuous roll sheet R1 is dropped together with the holding flanges 110 into the groove 121*a* of the flange holder 121. The sheet feeding unit 102*a* is slid on the guide rail 102*b* to return into the apparatus body. In this case, as described below, a driving source of the apparatus body side, the sheet feeding roller pair 104, and the rotary shaft of the continuous roll sheet are connected together.

When the sheet is fed to the printing unit 104, the sheet feeding roller pair 104 is rotated by driving transmitted from the sheet feeding roller driving unit 105, and the sheet pinched by the sheet feeding roller pair 104 is fed into the sheet conveyance path 101. When the sheet is wound back to the sheet housing unit 102, the roll is rotated by driving transmitted from the roll driving unit 107 to wind back the sheet. In this case, the sheet feeding roller pair 104 is separated or rotated reversely to the conveying direction rotation to convey the sheet.

A relationship in speed between the sheet feeding roller driving unit 105 and the roll driving unit 107 during the winding-back is controlled so that the speed of the roll driving unit 107 can always be higher to apply tension on the sheet between the sheet feeding roller pair 104 and the roll. The sheet conveying speed difference between the sheet feeding roller driving unit 105 and the roll driving unit 107 is eliminated by sliding a clutch (not illustrated) disposed in the roll driving unit 107.

Figure 13A:
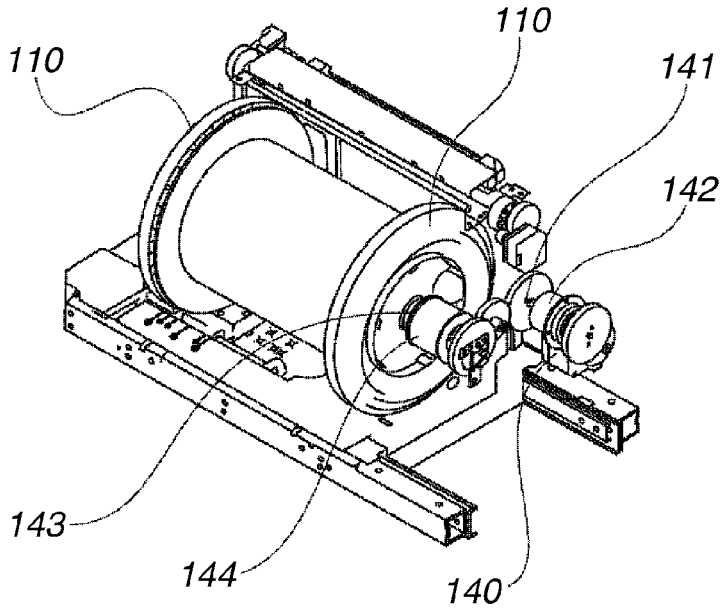
FIGS. 13A and 13B illustrate a configuration and an operation of a roll driving unit.
Figure 13B:
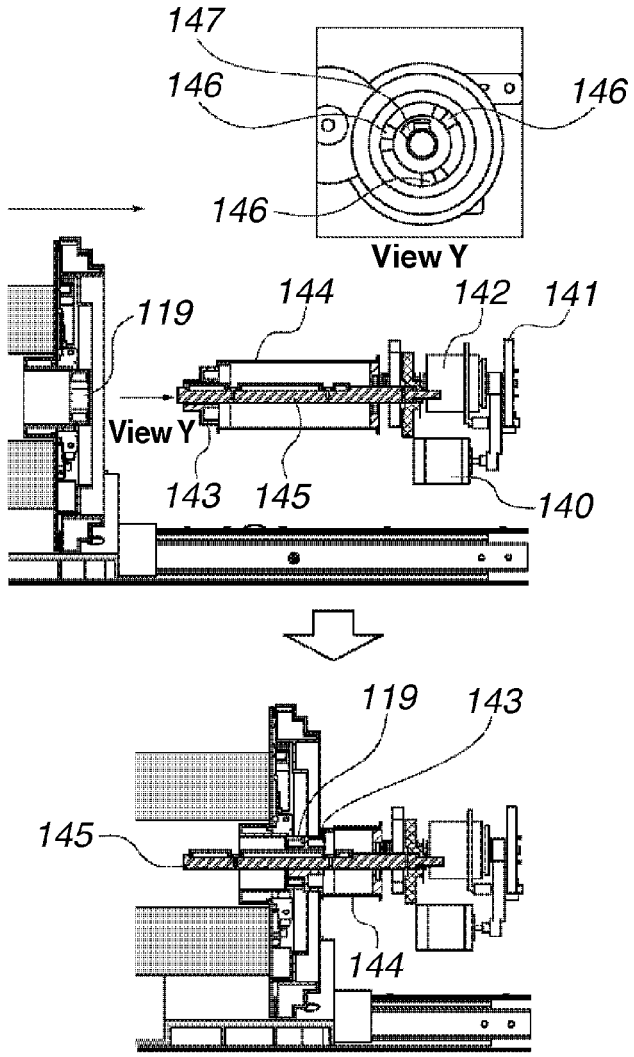

FIGS. 13A to 13C illustrate a configuration and an operation of the roll driving unit 107. FIG. 13A illustrates a perspective view of the roll driving unit 107. FIG. 13B is a section view illustrating a state where a driving transmission mechanism is connected when the roll is housed in the apparatus body.

The roll driving unit 107 includes a motor 140 that serves as a driving source for rotating the roll, and a gear group 141 for transmitting driving from the motor 140. A clutch 142 applies tension between the roll and the sheet feeding roller pair 104 during the winding-back. An apparatus body side coupling 143 connected to the coupling 119 that is the driven unit of the holding flange 110 is slidably supported by a rotary shaft 145, and urged to the holding flange 110 side by a coupling spring 144. The apparatus body side coupling 143 includes an introduction portion 146 oblique to an axial direction of the rotary shaft 145, and a gap 147 is generated in a rotational direction of the rotary shaft 145. For connection, the apparatus body side coupling 143 is rotated within a certain range so that it can be smoothly connected to the holding flange side coupling 119.

When the flange holder 121 holding the continuous roll sheet R1 on which the holding flanges 110 have been loaded is pushed on the guide rail 102*b* into the apparatus body, the holding flange side coupling 119 and the apparatus body side coupling 143 engage with each other. When the flange holder 121 is further moved to a predetermined position in the apparatus body, the apparatus body side coupling 143 moves along the rotary shaft 145 against an urging force of the coupling spring 144.

Figure 14A:
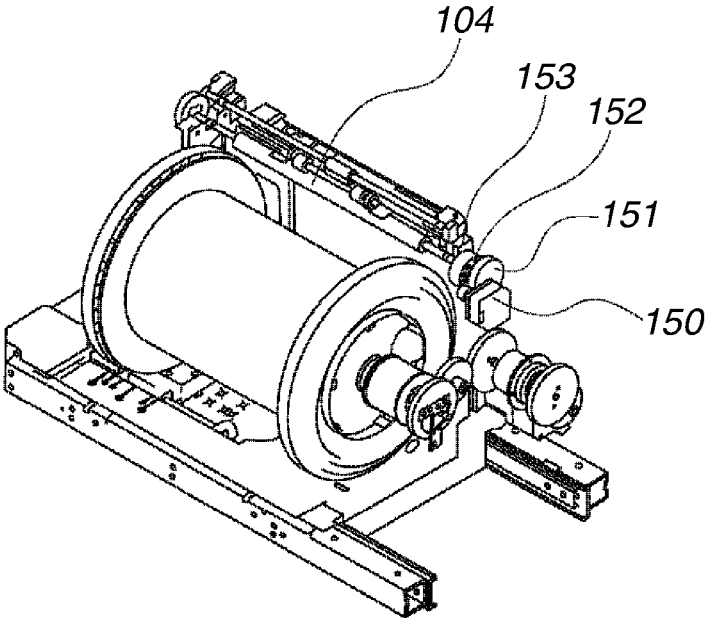
FIGS. 14A and 14B illustrate a configuration and an operation of a sheet feeding roller driving unit.
Figure 14B:
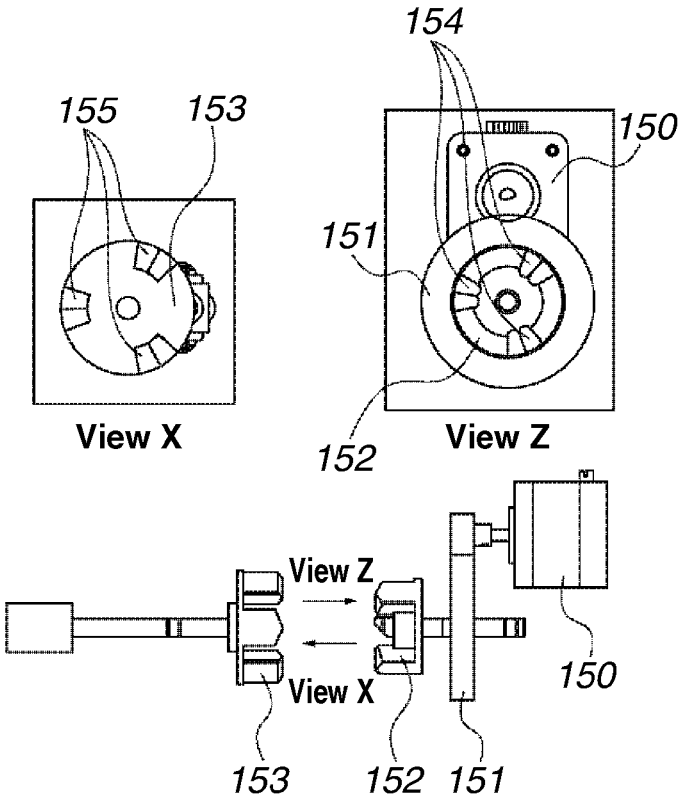

FIGS. 14A and 14B illustrate a configuration and an operation of the sheet feeding roller driving unit 105. FIG. 14A is a perspective view of the sheet feeding roller driving unit 105. FIG. 14B illustrates a state where the driving transmission mechanism is connected when the roll is housed in the apparatus body.

The sheet feeding roller driving unit 105 includes a driving source 150 for rotating the sheet feeding roller pair 104, a gear group 151 for transmitting driving from the driving source 150, and an apparatus body side coupling 152 for connecting the driving. The apparatus body side coupling 152 includes an introduction portion 154 oblique to an axial direction of the sheet feeding roller pair 104. The sheet feeding roller pair 104 is pulled out together with the roll during roll replacement, and housed in the apparatus body in a state where a leading end of the roll is pinched therebetween. A connection portion of the sheet feeding roller pair side includes a sheet feeding roller pair side coupling 153 having an introduction portion 155 oblique to the axial direction of the sheet feeding roller pair 104, and facilitates engagement with the apparatus body side coupling 152.

Figure 15A:
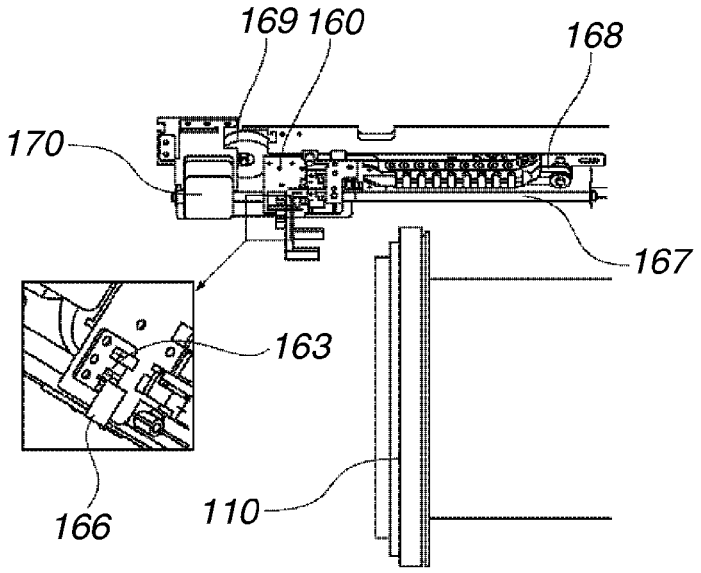
FIGS. 15A to 15C illustrate a configuration and an operation of a detection mechanism unit of a sheet type and a sheet width.
Figure 15B:
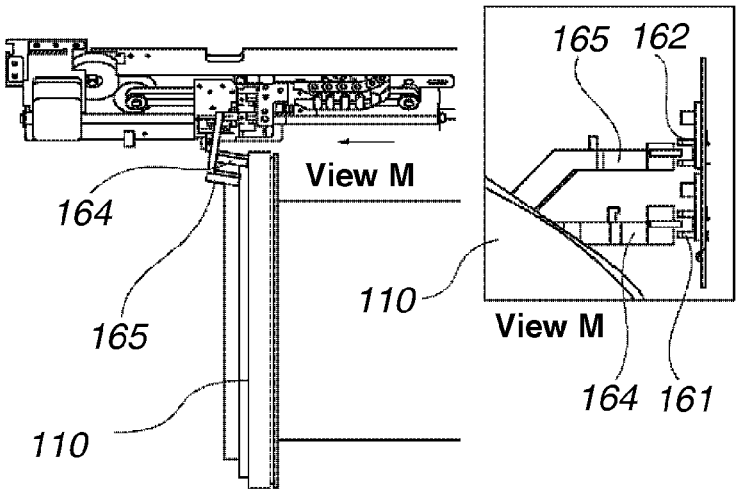
Figure 15C:
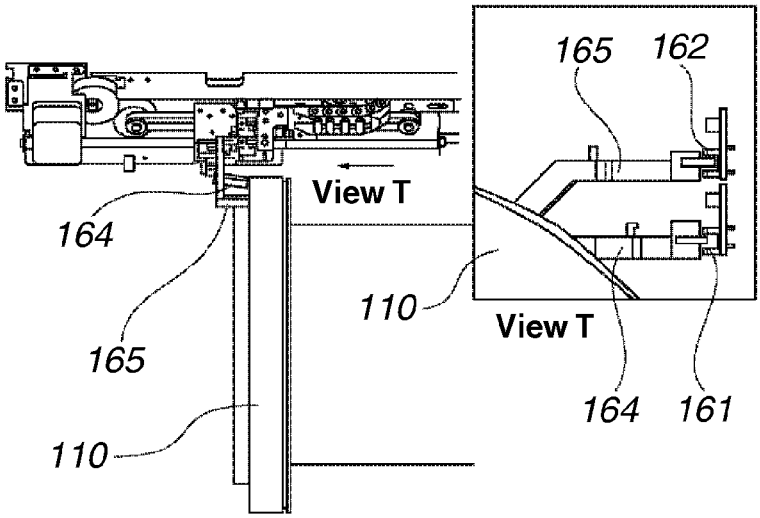

FIGS. 15A to 15C illustrate a configuration and an operation of the detection mechanism unit 106 that detects a sheet type and a sheet width. FIG. 15A illustrates a state where a detection unit is located in an operation reference position. FIG. 15B illustrates a state where a roll for one-sided printing is detected. FIG. 15C illustrates a state where a roll for two-sided printing is detected.

The detection mechanism unit 106 of a sheet type and a sheet width includes a carriage 160, a carriage shaft 167, a driving transmission belt 168, a driving transmission gear group 169, and a driving source 170. The carriage 160 on which sensors A161, B162, and C163, and sensor flags A164, B165, and C166 are mounted reciprocates in an axial direction of the carriage shaft 167. For an operation reference position of the carriage 160, the sensor flag C166 is detected by the sensor C163, and the carriage 160 is stopped.

A sheet width is determined based on a driving amount from the operation reference position of the carriage 160 to detection of the sensor A161 by the sensor flag A164. The sensor flag A164 abuts on the holding flange 110 of the roll loaded on the flange holding member 103, and rotates around the rotary shaft (not illustrated).

Concerning a method for identifying the one-sided printing roll or the two-sided printing roll, the roll is determined based on an output state of the sensor B162 when the sensor A161 detects the holding flange 110. In the present exemplary embodiment, a shape of the holding flange 110 on which the sensor flag B165 abuts is varied, so that the one-sided printing or the two-sided printing is identified.

Figure 16:
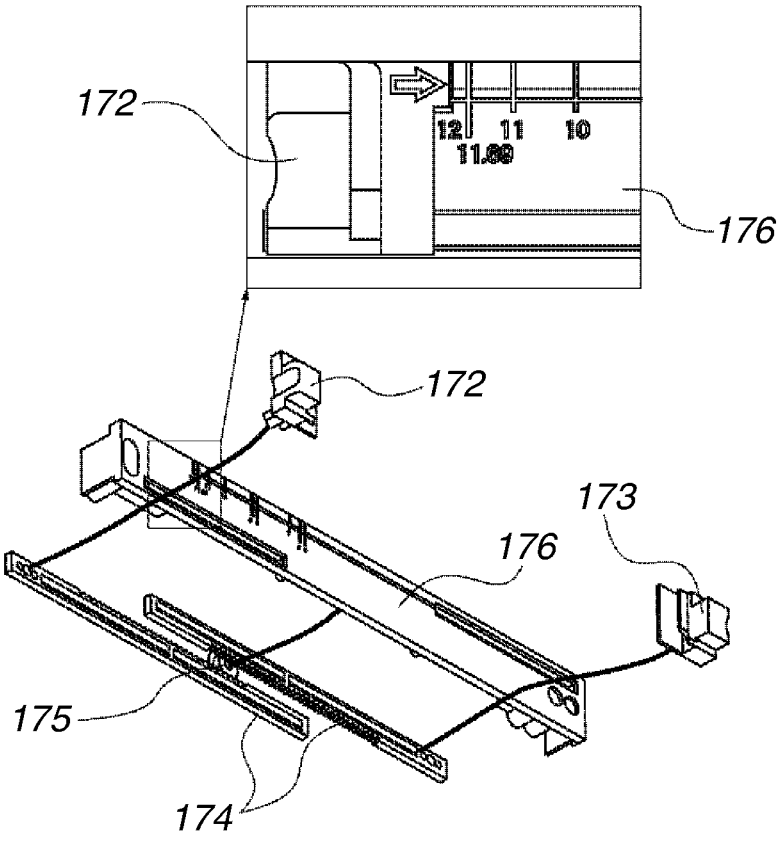
FIG. 16 illustrates a configuration and an operation of a sheet end pressing mechanism near a sheet feeding roller pair.

FIG. 16 illustrates a configuration and an operation of a sheet end pressing mechanism 171 near the sheet feeding roller pair 104. The sheet end pressing mechanism 171 includes a left pressing member 172 and a right pressing member 173 with respect to the sheet conveying direction, a rack member 174 and a gear 175 for interconnecting the left and right pressing members, and a conveyance guide 176 having a sheet width inscribed thereon.

The left and right pressing members can slide and stop on the conveyance guide 176 in a direction orthogonal to the sheet conveying direction. The pressing members abut on the respective end of the conveyed sheet to suppress skewing during the sheet conveyance. The sheet end pressing mechanism 171 can operate cooperatively with the flange holding member 103. When the roll is loaded on the flange holding member 103, the sheet end pressing mechanism 171 can stop at a sheet-width position of the loaded roll.

As described above, according to the present exemplary embodiment, in the loading relationship between the continuous roll sheet and the holding flange, the holding flange can be fitted to the roll sheet irrespective of a winding direction of the continuous roll sheet. Even when the continuous roll sheet to which the holding flanges have been fitted is loaded in the sheet housing unit mistaking its winding direction, the winding direction can be corrected without reloading the holding flanges on the roll sheet. Furthermore, roll sheet replacement work can be improved by eliminating a phase of the holding flange loading method.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-100087 filed Apr. 23, 2010, which is hereby incorporated by reference herein in its entirety.

What is claimed is:

1. An apparatus comprising:

a first flange which includes a first shaft portion and a first fixing portion, wherein the first shaft portion is configured to be locked to a core of a continuous roll sheet and to be rotated with the continuous roll sheet relative to the first fixing portion;

a second flange which includes a second shaft portion and a second fixing portion, wherein the second shaft portion is configured to be locked to the core of the continuous roll sheet and to be rotated with the continuous roll sheet relative to the second fixing portion; and a supporting unit configured to support the continuous roll sheet, wherein the supporting unit abuts on the first fixing portion and the second fixing portion, when the first shaft portion and the second shaft portion are inserted into both ends of the core of the continuous roll sheet and locked to the core, and then the continuous roll sheet is dropped on the supporting unit with the first flange and the second flange, wherein the first flange further includes a driven portion configured to receive a drive, and wherein, in a case where the driven portion receives the drive in a state in which the first shaft portion and the second shaft portion are locked to the core and the first fixing portion and the second fixing portion abut on the supporting unit, the first shaft portion and the second shaft portion are rotated relative to the first fixing portion and the second fixing portion, and the continuous roll sheet is rotated with the first shaft portion and the second shaft portion and is pulled out by the rotation.

2. The apparatus according to claim 1, wherein the supporting unit regulates a position, in an axial direction of the continuous roll sheet and in a direction intersecting the axial direction, of the first flange and the second flange.

3. The apparatus according to claim 1, wherein the supporting unit includes a circular-arc groove configured to abut on the first fixing portion and the second fixing portion.

4. The apparatus according to claim 1, further comprising a drive transmitting member configured to transmit a drive to the driven portion of the first shaft portion, wherein the first shaft portion is rotated relative to the first fixing portion by a drive transmitted from the drive transmitting member to the driven portion.

5. The apparatus according to claim 4, wherein the drive transmitting member includes a driving unit and a connection unit, and the drive transmitting member transmits a drive by the driving unit to the driven portion to which the connection unit is connected.

6. The apparatus according to claim 1, further comprising a sheet feeding roller configured to feed the continuous roll sheet.

7. The apparatus according to claim 1, wherein each outer circumferential portion of the first fixing portion and the second fixing portion has a circular or polygonal shape.

8. The apparatus according to claim 7, wherein the supporting unit has a circular-arc groove to receive the outer circumferential portion of each of the first fixing portion and the second fixing portion.

9. The apparatus according to claim 1, wherein each of the first flange and the second flange further comprises a locking member configured to lock each of the first shaft portion and the second shaft portion to the core of the continuous roll sheet in a case where the first shaft portion and the second shaft portion are inserted into the core.

10. The apparatus according to claim 9, wherein the first shaft portion has a first surface configured to contact one end of the continuous roll sheet, and the second shaft portion has a second surface configured to contact another end of the continuous roll sheet, and wherein each of the first shaft portion and the second shaft portion is locked to the core in a case where a portion of each of the locking members protrudes from a respective one of the first surface and the second surface and bites into the core.

11. The apparatus according to claim 10, wherein a portion of each of the locking members protrudes from a respective one of the first surface and the second surface, in accordance with an operation by a user.

12. A printing apparatus comprising an apparatus according to claim 1; and a print unit configured to perform printing on a continuous roll sheet pulled out by the apparatus.

13. The printing apparatus according to claim 12, further comprising:

a cutter configured to cut a sheet pulled out from the continuous roll sheet, the sheet having a first surface on which an image is printed by the printing unit; and a drum configured to wind the sheet cut by the cutter, and to feed the wound sheet, wherein the drum winds the sheet by rotating, and feeds the wound sheet by rotating reversely, and wherein the sheet is inverted by a rotation of the drum, and the printing unit prints an image on a second surface of the sheet fed by the drum.

14. The apparatus according to claim 1, wherein the supporting unit has a first supporting unit for supporting the first flange and a second supporting unit for supporting the second flange.

15. The apparatus according to claim 14, wherein the second supporting unit is able to move relative to the first supporting unit in an axial direction of the continuous roll sheet.

16. The apparatus according to claim 15, further comprising a guiding member configured to guide the first flange in the axial direction of the continuous roll sheet.

17. An apparatus comprising:

a first flange which includes a first shaft portion and a first fixing portion, wherein the first shaft portion is configured to be locked to a core of a continuous roll sheet and to be rotated with the continuous roll sheet relative to the first fixing portion;

a second flange which includes a second shaft portion and a second fixing portion, wherein the second shaft portion is configured to be locked to the core of the continuous roll sheet and to be rotated with the continuous roll sheet relative to the second fixing portion;

a supporting unit configured to support the continuous roll sheet, wherein the supporting unit abuts on the first fixing portion and the second fixing portion when the first shaft portion and the second shaft portion are inserted into both ends of the core of the continuous roll sheet and locked to the core, and then the continuous roll sheet is dropped on the supporting unit with the first flange and the second flange, wherein the first flange further includes a driven portion configured to receive a drive, and wherein, in a case where the driven portion receives the drive in a state in which the first shaft portion and the second shaft portion are locked to the core and the first fixing portion and the second fixing portion abut on the supporting unit, the first shaft portion and the second shaft portion are rotated relative to the first fixing portion and the second fixing portion, and the continuous roll sheet is rotated with the first shaft portion and the second shaft portion and is pulled out by the rotation;

a sheet feeding roller configured to feed the continuous roll sheet; and a recording unit configured to perform recording on the continuous roll sheet fed by the sheet feeding roller.

18. The apparatus according to claim 17, wherein the supporting unit regulates a position, in an axial direction of the continuous roll sheet and in a direction intersecting the axial direction, of the first flange and the second flange.

19. The apparatus according to claim 18, wherein the first supporting unit includes a circular-arc groove configured to abut on the first fixing portion and the second fixing portion.

20. The apparatus according to claim 17, further comprising a guiding member configured to guide the first flange in an axial direction of the continuous roll sheet.

21. The according to claim 17, further comprising a drive transmitting member configured to transmit a drive to the driven portion of the first shaft portion.

22. The apparatus according to claim 17, wherein each of the first flange and the second flange is loaded onto a respective end of the continuous roll sheet, and the supporting unit has a first supporting unit for supporting the first flange and a second supporting unit for supporting the second flange.

23. The apparatus according to claim 22, wherein the second supporting unit is able to move relative to the first supporting unit in an axial direction of the continuous roll sheet.

24. The apparatus according to claim 17, further comprising:

a cutter configured to cut a sheet pulled out from the continuous roll sheet, the sheet having a first surface on which an image is recorded by the recording unit, and a drum configured to wind the sheet cut by the cutter, and to feed the wound sheet, wherein the drum winds the sheet by rotating, and feeds the wound sheet by rotating reversely, and wherein the sheet is inverted by a rotation of the drum, and the recording unit records an image on a second surface of the sheet fed by the drum.

25. A method comprising:

attaching a first shaft portion of a first flange to one end of a continuous roll sheet, wherein the first flange includes the first shaft portion and the first fixing portion, and the first shaft portion is configured to be locked to a core of a continuous roll sheet and to be rotated with the continuous roll sheet relative to the first fixing portion;

attaching a second shaft portion of a second flange to another end of the continuous roll sheet, wherein the second flange includes the second shaft portion and the second fixing portion, and the second shaft portion is configured to be locked to the core of the continuous roll sheet and to be rotated with the continuous roll sheet relative to the first fixing portion; and dropping, after the attaching of the first shaft portion and the second shaft portion, the continuous roll sheet on a supporting unit which can support the continuous roll sheet, wherein the dropping includes abutting on the first fixing portion and the second fixing portion on the supporting unit, wherein the first flange further includes a driven portion configured to receive a drive, and wherein, in a case where the driven portion receives the drive in a state that the first shaft portion and the second shaft portion are locked to the core and the first fixing portion and the second fixing portion have been supported by the supporting unit, the first shaft portion and the second shaft portion are rotated relative to the first fixing portion and the second fixing portion, and the continuous roll sheet is rotated with the first shaft portion and the second shaft portion and is pulled out by the rotation.

* * * * *